US012497255B2

(12) United States Patent
Tokuda et al.

(10) Patent No.: US 12,497,255 B2
(45) Date of Patent: Dec. 16, 2025

(54) CONVEYING APPARATUS AND RECORDING DEVICE

(71) Applicant: CANON KABUSHIKI KAISHA, Tokyo (JP)

(72) Inventors: Shuichi Tokuda, Kanagawa (JP); Takashi Sasaki, Kanagawa (JP); Yuki Emoto, Tokyo (JP); Koki Kudo, Kanagawa (JP); Hideyasu Ishihara, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 18/467,461

(22) Filed: Sep. 14, 2023

(65) Prior Publication Data

US 2024/0101373 A1 Mar. 28, 2024

(51) Int. Cl.
*B65H 5/06* (2006.01)

(52) U.S. Cl.
CPC ..... *B65H 5/062* (2013.01); *B65H 5/06* (2013.01); *B65H 2402/50* (2013.01); *B65H 2403/45* (2013.01)

(58) Field of Classification Search
CPC ..... B65H 5/06; B65H 5/062; B65H 29/12; B65H 29/20; B65H 2402/50; B65H 2402/60; B65H 2403/45; B65H 2404/16; B65H 2404/164
See application file for complete search history.

(56) References Cited

U.S. PATENT DOCUMENTS

| | | | | |
|---|---|---|---|---|
| 11,204,576 | B2 * | 12/2021 | Niikawa | F16H 1/08 |
| 2007/0273093 | A1 * | 11/2007 | Takeuchi | B65H 43/08 271/265.01 |
| 2014/0319764 | A1 * | 10/2014 | Saito | F16D 3/68 74/411 |
| 2017/0341886 | A1 * | 11/2017 | Hishinuma | G03B 27/6264 |

FOREIGN PATENT DOCUMENTS

| | | |
|---|---|---|
| JP | 2001-278495 | 10/2001 |

* cited by examiner

*Primary Examiner* — Prasad V Gokhale
(74) *Attorney, Agent, or Firm* — Venable LLP

(57) ABSTRACT

Provided is a conveying apparatus, including: a conveying roller that conveys a recording medium; a first helical gear that rotates integrally with the conveying roller; a gear unit that engages with the first helical gear and generates a thrust force to the conveying roller. The gear unit includes a second helical gear and a third helical gear, and a thrust force that the conveying roller receives from the second helical gear acts in an opposite direction of a thrust force that the conveying roller receives from the third helical gear.

12 Claims, 9 Drawing Sheets

CONVEYING APPARATUS AND RECORDING DEVICE

BACKGROUND OF THE INVENTION

Field of the Invention

The present invention relates to a conveying apparatus that holds and carries a recording medium using conveying means, and is installed in a recording device that performs a recording operation.

Description of the Related Art

Such a recording device as an inkjet printer that is commonly used is configured so that a recording medium is conveyed by a conveying apparatus constituted of a conveying roller and a plurality of gears. In this conveying apparatus, a configuration using a helical gear is known, in order to reduce operation sounds caused by the hitting sound of the gears and the like.

Japanese Patent Application Publication No. 2001-278495 discloses a conveying apparatus, which is installed in a recording device and is configured to drive a conveying roller to convey a recording medium using a plurality of helical gears. In this configuration, the rattling of the conveying roller in the rotary shaft direction is prevented using the thrust force that the helical gear generates on the conveying roller in the rotary shaft direction.

SUMMARY OF THE INVENTION

However, in the above configuration, at a timing when the rotating direction of the conveying roller switches, the direction of the thrust force generated by the helical gear reverses, which may move the conveying roller in the rotary shaft direction. The movement of the conveying roller in the rotary shaft direction moves the paper, which is being conveyed by the conveying roller, in the rotary shaft direction, and causes a drop in printing quality.

With the foregoing in view, it is an object of the present invention to provide a conveying apparatus for conveying a recording medium, the apparatus preventing movement of a conveying roller in the rotary shaft direction when the conveying roller is driven.

To achieve the above object, the conveying apparatus of the present invention includes:

- a conveying roller that conveys a recording medium;
- a first helical gear that rotates integrally with the conveying roller; and
- a gear unit that engages with the first helical gear and generates a thrust force to the conveying roller, wherein
- the gear unit includes a second helical gear and a third helical gear, wherein
- a thrust force that the conveying roller receives from the second helical gear acts in an opposite direction of a thrust force that the conveying roller receives from the third helical gear.

According to the present invention, in a conveying apparatus for conveying a recording medium, movement of a conveying roller in the rotary shaft direction can be prevented when the conveying roller is driven.

Further features of the present invention will become apparent from the following description of exemplary embodiments with reference to the attached drawings.

DESCRIPTION OF THE EMBODIMENTS

Figure 1:
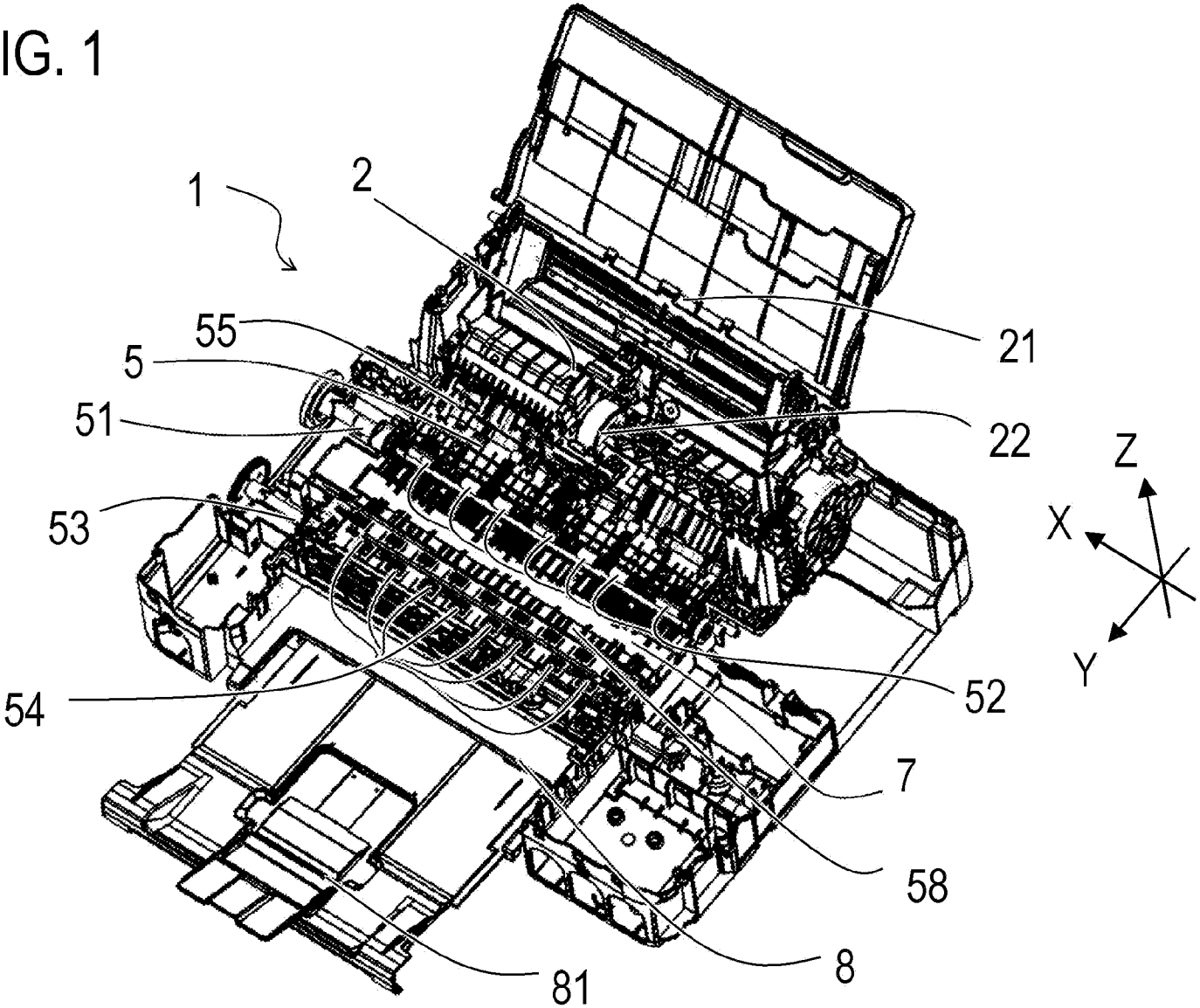
FIG. 1 is a perspective view depicting an internal configuration of a recording device according to Embodiment 1.

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments. A plurality of features are described in each of the following embodiments, but all of these features are not essential for the invention, and these features may be arbitrarily combined. In the accompanying drawings, an identical or similar composing element is denoted with a same reference numeral, and redundant description may be omitted.

In the following description, "recording" (or "printing" in some cases) includes a case of forming an image, a pattern, and the like, on a recording medium, or a case of processing the medium. In other words, "recording" is not limited to forming such significant information as text and graphics, but also includes insignificant information, and is not limited to the recording information which has been actualized for humans to recognize visually. "Recording medium (paper)" is not only recording paper used for a commonly used image forming apparatus, but includes such conveyable medium as cloth, plastic film (OHP), metal plate, glass, ceramics, wood and leather.

Embodiment 1

Recording Apparatus 1

An outline of an inkjet recording device according to Embodiment 1 of the present invention will be described. FIG. 1 is a perspective view depicting a major configuration inside the recording device 1 according to Embodiment 1. The recording device 1 is an inkjet recording device that performs a recording operation on a recording medium while scanning the recording medium with a recording head in a direction approximately perpendicular to the conveying direction of the recording medium. In each drawing, the scanning direction with the recording head (X direction), the direction of conveying the recording medium facing the recording head (Y direction), and the vertical direction (Z direction) are indicated when needed. In Embodiment 1, the X direction, the Y direction and the Z direction are approximately perpendicular to each other.

The recording device 1 includes: a feeding portion 2 which separates and feeds a recording medium one-by-one; a conveying portion 5 which is a conveying apparatus to convey the recording material fed by the feeding portion 2; and a recording portion 7 which performs recording operation on the recording medium conveyed by the conveying portion 5. The recording device 1 also includes: a driving motor 6 (see FIG. 2) which is a driving source to drive a conveying roller 51 and the like disposed on the conveying portion 5; and a delivery portion 8 which delivers and loads the recording medium on which an image is recorded by the recording portion 7.

The feeding portion 2 includes: a loading portion 21 which loads a recording medium, and a feeding roller 22 which feeds the recording medium loaded in the loading portion 21. The recording medium loaded in the loading portion 21 is conveyed to the conveying portion 5 by the feeding roller 22.

The conveying portion 5 includes: the conveying roller 51, a pinch roller 52 that faces the conveying roller 51, a discharging roller 53, and a spur 54 that faces the discharging roller 53. The conveying roller 51 and the discharging roller 53 are rollers which are long in a rotary shaft direction, and the rotary shaft direction is approximately parallel with the scanning direction of the recording head. In the conveying direction of the recording medium, the conveying roller 51 and the pinch roller 52 are disposed on the upstream side of the recording portion 7, and the discharging roller 53 and the spur 54 are disposed on the downstream side of the recording portion 7.

The delivery portion 8 includes a delivery tray 81 where the recording medium discharged by the discharging roller 53 is loaded. The operator can collect the recording medium on which an image is recorded from the delivery tray 81.

Next, the conveying path of the recording medium, from the feeding portion 2 to the delivery portion 8, will be described in detail. The recording medium fed from the feeding portion 2 to the conveying portion 5 by the feeding roller 22 is nipped by the pinch roller 52 and the conveying roller 51, and is conveyed to the recording portion 7. The pinch roller 52 is energized toward the conveying roller 51 by a pinch roller holder 55.

An image is recorded on the recording medium conveyed to the recording portion 7, using ink discharged by a recording head (not illustrated) and a nozzle (not illustrated). In the recording portion 7, the recording operation is performed at an arbitrary position on the recording medium in the width direction by the recording head moving in the scanning direction (X direction). The recording medium on which an image was recorded by the recording portion 7 is discharged to the delivery tray 81 by the discharging roller 53 and the spur 54. In other words, on the conveying path of the recording medium from the feeding portion 2 to the delivery portion 8, the feeding portion 2 is located on the upstream side in the conveying direction of the conveying portion 5, and the delivery portion 8 is located on the downstream side in the conveying direction of the conveying portion 5.

The driving motor 6 is a driving source to rotary-drive the conveying roller 51, the discharging roller 53, and the feeding roller 22. By a driving transmission mechanism constituted of a plurality of helical gears and the like, the driving force of the driving motor 6 is transmitted to the conveying roller 51 and the like. The driving motor 6 may be regarded as a driving source of the conveying portion 5, which is the conveying apparatus, for example.

Figure 2:
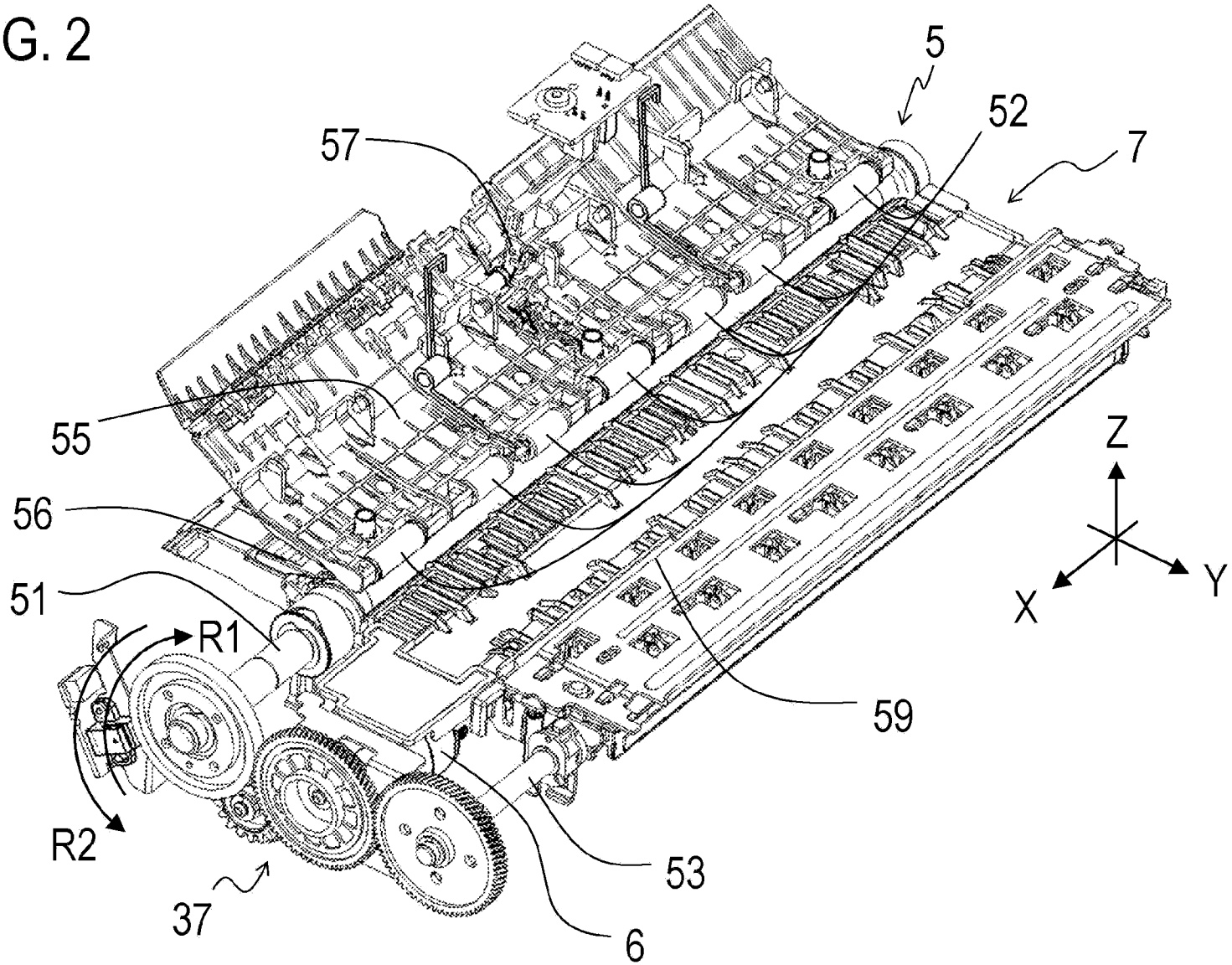
FIG. 2 is a perspective view of a conveying portion according to Embodiment 1.

The recording medium fed from the feeding portion 2 is guided to the conveying roller 51 of the conveying portion 5 via the conveying path constituted of the pinch roller holder 55 and a guide portion 56 (see FIG. 2). In the conveying direction of the recording medium, a platen 58 is disposed between the conveying roller 51 and the discharging roller 53. The platen 58 guides the recording medium such that the distance between the recording medium conveyed to the recording portion 7 and the nozzle of the recording head is kept constant.

Conveying Portion 5

Next, the configuration of the conveying portion 5 will be described in detail. FIG. 2 is a perspective view of the conveying portion 5, including a gear train 37. The conveying portion 5 includes the gear train 37 which connects the conveying roller 51 and discharging roller 53 with the driving motor 6. When the driving motor 6 drives the conveying roller 51 in a first rotating direction R1 indicated in FIG. 2, the conveying roller 51 and discharging roller 53 rotate in the direction of conveying the recording medium to the downstream side in the conveying direction respectively. When the driving motor 6 drives the conveying roller 51 in a second rotating direction R2 indicated in FIG. 2, on the other hand, the conveying roller 51 and discharging roller 53 rotate in the direction of conveying the recording medium to the upstream side in the conveying direction respectively. In the following description, the rotation of the conveying roller 51 and discharging roller 53, when the recording medium is conveyed to the downstream side in the conveying direction, is referred to as a "forward rotation", and the rotation of the conveying roller 51 and discharging roller 53, when the recording medium is conveyed to the upstream side in the conveying direction, is referred to as a "backward rotation".

The recording medium fed by the feeding portion 2 is guided by the pinch roller holder 55 and the guide portion 56, and is fed to the conveying roller 51. An edge detection lever 57 is disposed in the pinch roller holder 55. By the recording medium rotating the edge detection lever 57 when passing above the pinch roller holder 55, the front end position and rear end position of the recording medium are detected by the edge detection lever 57.

The driving amount of the driving motor 6 is detected by an encoder (not illustrated). By performing various controls, such as PID control, the speed and driving amount of the driving motor 6 are controlled. If the edge detection lever 57 detects the front end position of the recording medium during the feeding operation and the rear end position of the recording medium during the recording operation or discharging operation, the actual length of the recording medium in the conveying direction can be measured based on the driving amount of the driving motor 6 required from detecting the front end position to detecting the rear end position.

The recording medium which was fed to the conveying roller 51 receives a skew correction operation and the like, and is then conveyed to the recording portion 7. Then by the recording head disposed on the recording portion 7, a recording operation is performed on the recording medium, which was conveyed to the recording portion 7. The recording medium conveyed from the conveying roller 51 is guided to the platen 58 and a spur base 59, and reaches the discharging roller 53. While the recording operation is performed on the recording medium, the recording medium is conveyed by the conveying roller 51, or by the discharging roller 53, or by both of these rollers. The recording medium on which an image was recorded is then discharged to the delivery tray 81 using the discharging roller 53.

Gear Train 37

Figure 3:
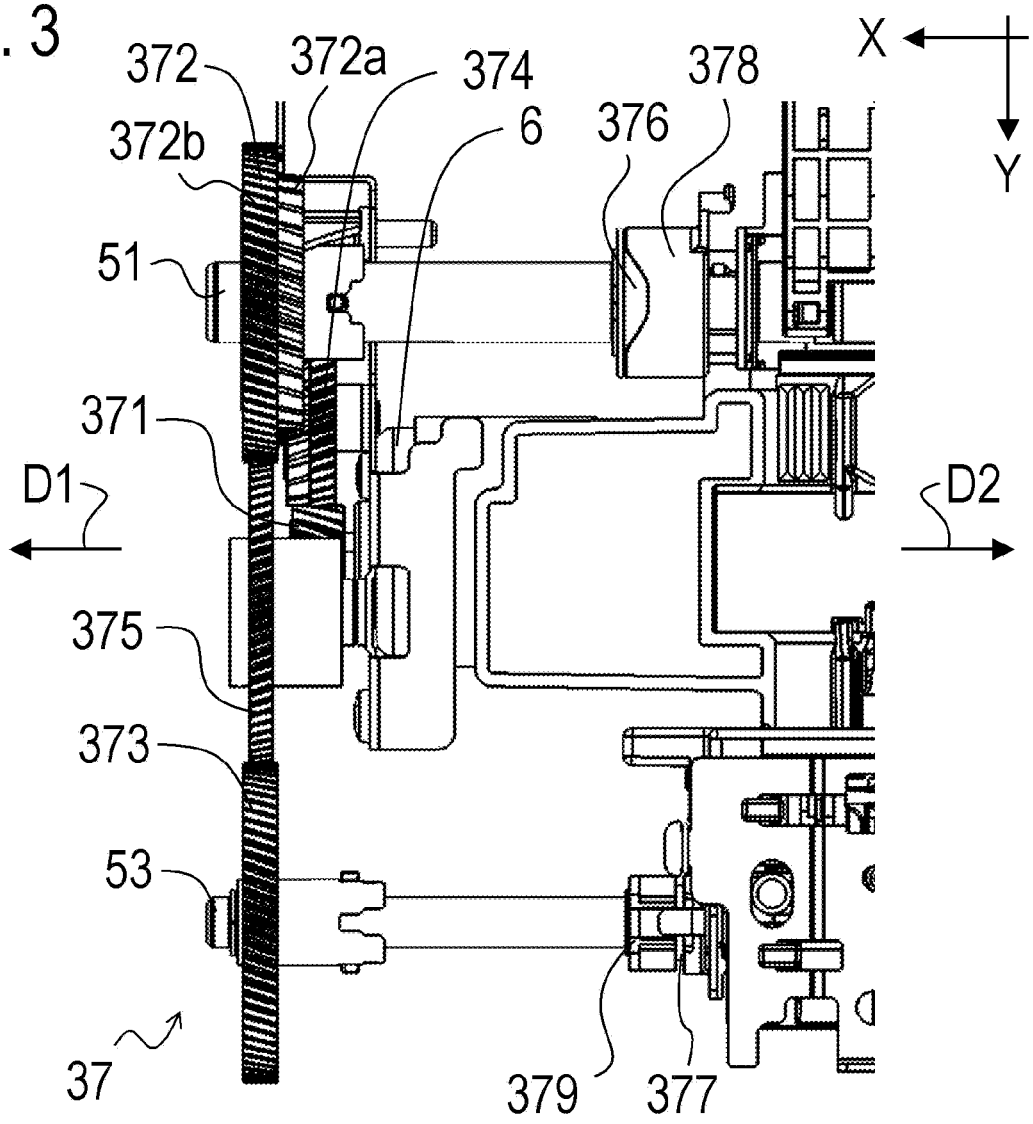
FIG. 3 is a top view depicting a gear train of the conveying portion according to Embodiment 1.

Next, the configuration of the gear train 37, which is located at the edge of the conveying portion 5 in the rotary shaft direction of the conveying roller 51, will be described in detail. FIG. 3 is a top view depicting a configuration of the gear train 37 and peripheral members thereof. The gear train 37 includes: a driving motor gear 371 which is press-fitted in the driving motor 6, a conveying roller gear 372 which is press-fitted in the conveying roller 51, and a discharging roller gear 373 which is press-fitted in the discharging roller 53 and rotates integrally with the discharging roller 53. The gear train 37 further includes a conveying idler gear 374 which engages with the driving motor gear 371 and the conveying roller gear 372, and a discharging idler gear 375 which engages with the discharging roller gear 373 and the conveying roller gear 372. The driving motor gear 371, the conveying roller gear 372, the discharging roller gear 373, the conveying idler gear 374, and the discharging idler gear 375 are all helical gears, and tooth trace directions thereof are inclined with respect to the rotary shaft direction. By using helical gears for the gears included in the gear train 37, the hitting sounds generated when the gears contact with each other can be reduced compared with the case of using spur gears.

The conveying roller gear (first helical gear) 372 has a two-step gear configuration. By using the two-step configuration for the conveying roller gear 372, the strength of the gear train 37 can be improved compared with a configuration of disposing a plurality of gears instead of the conveying roller gear 372. A first gear portion 372*a* of the conveying roller gear 372 is engaged with the conveying idler gear (second helical gear) 374, and is drive-coupled with the driving motor gear 371 via the conveying idler gear 374. A second gear portion 372*b* of the conveying roller gear 372 is engaged with the discharging idler gear (third helical gear) 375, and is drive-coupled with the discharging roller gear (fourth helical gear) 373 via the discharging idler gear 375. The conveying roller gear 372, the driving motor gear 371 and the discharging roller gear 373 are configured to rotate in a same direction, and the conveying roller 51 and the discharging roller 53 always rotate in a same direction.

The driving force of the driving motor 6 is transmitted from the driving motor gear 371 to the conveying idler gear 374, from the conveying idler gear 374 to the conveying roller gear 372, from the conveying roller gear 372 to the discharging idler gear 375, and from the discharging idler gear 375 to the discharging roller gear 373. The tooth trace direction of the first gear portion 372*a* and the tooth trace direction of the second gear portion 372*b* of the conveying roller gear 372 are in the same direction. Therefore, a thrust force which the conveying roller gear 372 receives from the conveying idler gear 374, and a thrust force which the conveying roller gear 372 receives from the discharging idler gear 375 always turn in opposite directions. It is a characteristic of the present invention that the conveying roller gear 372 is configured such that the thrust force received from the conveying idler gear 374 and the thrust force received from the discharging idler gear 375 turn in opposite directions.

The conveying portion 5 further includes a conveying roller spring (first pressing means) 376 which is pressing means for pressing the conveying roller (first conveying roller) 51, and a discharging roller spring (second pressing means) 377 which is pressing means for pressing the discharging roller (second conveying roller) 53.

The conveying roller spring 376 and the discharging roller spring 377 are both energizing members which are disposed to allow an elastic force to act in the rotary shaft direction of the conveying roller 51. In Embodiment 1, the direction in which the conveying roller spring 376 energizes the conveying roller 51 and the direction in which the discharging roller spring 377 energizes the discharging roller 53 are the same. In the following description, it is assumed that a first direction D1 is a pressing direction in which the conveying roller spring 376 presses the conveying roller 51 in the rotary shaft direction of the conveying roller 51, and a second direction D2 is an opposite direction of the first direction D1. In Embodiment 1, the gear train 37 is disposed at the edge of the conveying portion 5 in the first direction D1.

The conveying portion 5 further includes a regulating member (first regulating means) 378 which is regulating means for regulating the movement of the conveying roller 51 in the first direction D1, and a regulating member (second regulating means) 379 which is regulating means for regulating movement of the discharging roller 53 in the first direction D1. In other words, the conveying roller 51 and the discharging roller 53 are pressed by the pressing means in the first direction D1, but the movement in the first direction D1 is regulated by the regulating means. In other words, the conveying roller spring 376 presses the conveying roller 51 toward the regulating member 378, and the discharging roller spring 377 presses the discharging roller 53 toward the regulating member 379. The conveying roller 51 and the discharging roller 53 may be configured such that when a force exceeding the pressing force of the pressing means acts in the second direction D2, which is the opposite direction of the first direction D1, the conveying roller 51 and the discharging roller 53 can be moved for the amount of clearance between these rollers.

Figure 4:
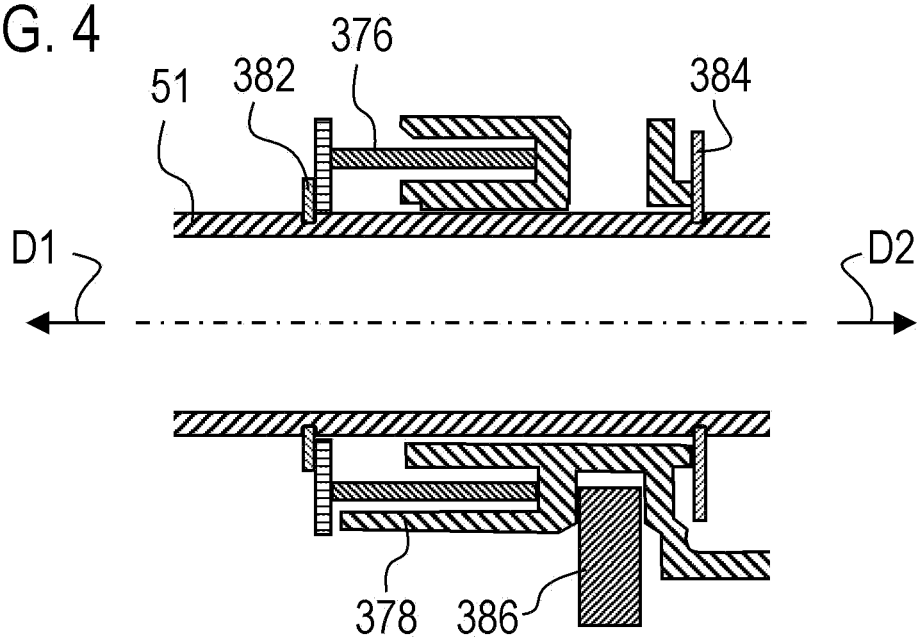
FIG. 4 is a cross-sectional view depicting a movement regulating mechanism of a conveying roller according to Embodiment 1.

Next, the mechanism of regulating the movement of the conveying roller 51 in the first direction D1 will be described in detail. FIG. 4 is a cross-sectional view depicting the movement regulating mechanism of the conveying roller 51. The movement regulating mechanism of the conveying roller 51 of Embodiment 1 includes a bottom 386 which is fixed to the main body of the recording device, and a regulating member 378 which is positioned with respect to the bottom 386. The regulating member 378 of Embodiment 1 is a bushing into which the conveying roller 51 is inserted.

Grooves to install a first slit ring 382 and a second slit ring 384 are formed on an outer peripheral surface of the conveying roller 51. The first slit ring 382 is located on the first direction D1 side of the conveying roller spring 376, and the second slit ring 384 is located on the second direction D2 side of the conveying roller spring 376.

In the rotary shaft direction of the conveying roller 51, the conveying roller spring 376 is located between the first slit ring 382 and the regulating member 378. The conveying roller spring 376 is disposed so as to extend in a direction parallel with the rotary shaft direction of the conveying roller 51. Therefore, by the conveying roller spring 376, the conveying roller 51 is energized in the first direction D1 via the first slit ring 382, and the regulating member 378 is energized in the second direction D2.

Further, in the rotary shaft direction of the conveying roller 51, a surface of the second slit ring 384 facing the first direction D1 faces a surface of the regulating member 378 facing the second direction D2. When the conveying roller 51 is energized in the first direction D1 by the conveying roller spring 376, the second slit ring 384 contacts with the regulating member 378. Then movement of the conveying roller 51 in the first direction D1 is regulated by the regulating member 378. A movement regulating mechanism, which includes the regulating member 379 and regulates the movement of the discharging roller 53 in the first direction D1, has the same configuration as the movement regulating mechanism of the conveying roller 51, hence the description thereof will be omitted. In the conveying apparatus according to the present invention, a known movement regulating mechanism other than the above mentioned mechanism for regulating a movement of the conveying roller 51 and the discharging roller 53 in the first direction D1 may be used.

Forces which Act on Conveying Roller 51

Next, force which act on the conveying roller 51 in the rotary shaft direction when the gear train 37 is driven will be described. The gear unit that engages with the conveying roller gear 372 and generates a thrust force on the conveying roller 51 includes the conveying idler gear 374 and the discharging idler gear 375. The conveying roller 51 is also pressed by the conveying roller spring 376 in the first direction D1.

Figure 5:
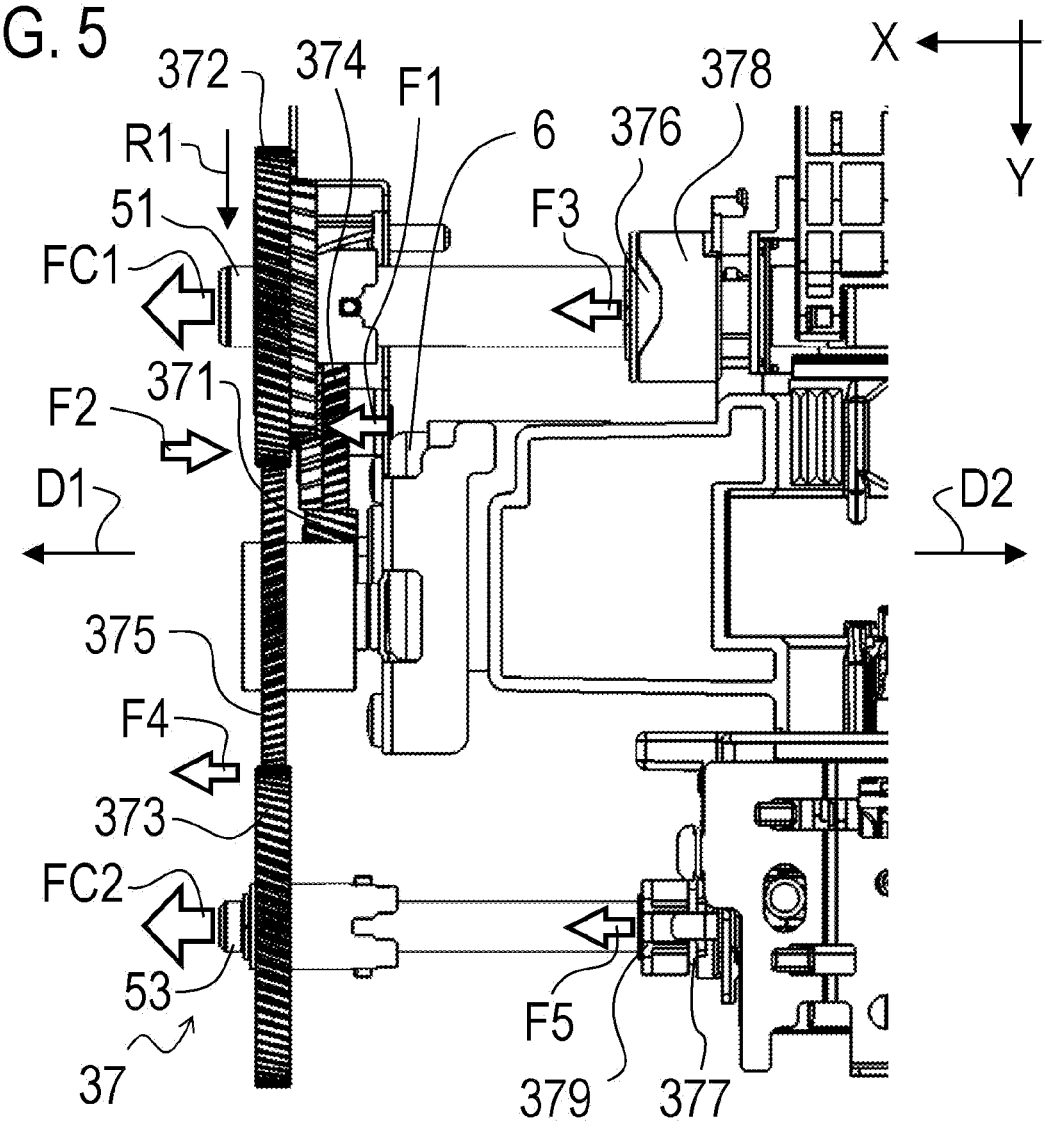
FIG. 5 is a top view depicting a state of the conveying roller in the forward rotation according to Embodiment 1.

First, force which act on the conveying roller 51, when the conveying roller 51 rotates in the first rotating direction R1 (forward rotation), will be described. FIG. 5 is a top view depicting a state where the conveying roller 51 performs forward rotation and the recording medium is conveyed to the downstream side in the conveying direction. In FIG. 5, a force F1 indicates the thrust force which the conveying roller gear 372 receives from the conveying idler gear 374, a force F2 indicates the thrust force which the conveying roller gear 372 receives from the discharging idler gear 375, and a force F3 indicates the pressing force which the conveying roller 51 receives from the conveying roller spring 376.

The direction of the tooth trace of each gear is configured such that the force F1 acts in the first direction D1 and the force F2 acts in the second direction D2 when the driving motor 6 drives the conveying roller 51 in the forward rotation direction. At this time, the conveying roller spring 376 energizes the conveying roller 51 in the first direction D1. Therefore, if it is assumed that the resultant force FC1, which acts on the conveying roller 51, acts in the first direction D1, the resultant force FC1 is given by FC1=F1−F2+F3.

The force F1 and the force F2 change depending on the conveying conditions (e.g., conveying speed, type of recording medium). The force F3, on the other hand, depends on the elastic force of the conveying roller spring 376. In Embodiment 1, the force F3 is set so as to satisfy the relationship of F3−F1+F2 within the assumed conveying conditions. The resultant force FC1 acts in the first direction D1, and the conveying roller 51 is energized in the first direction D1.

Figure 6:
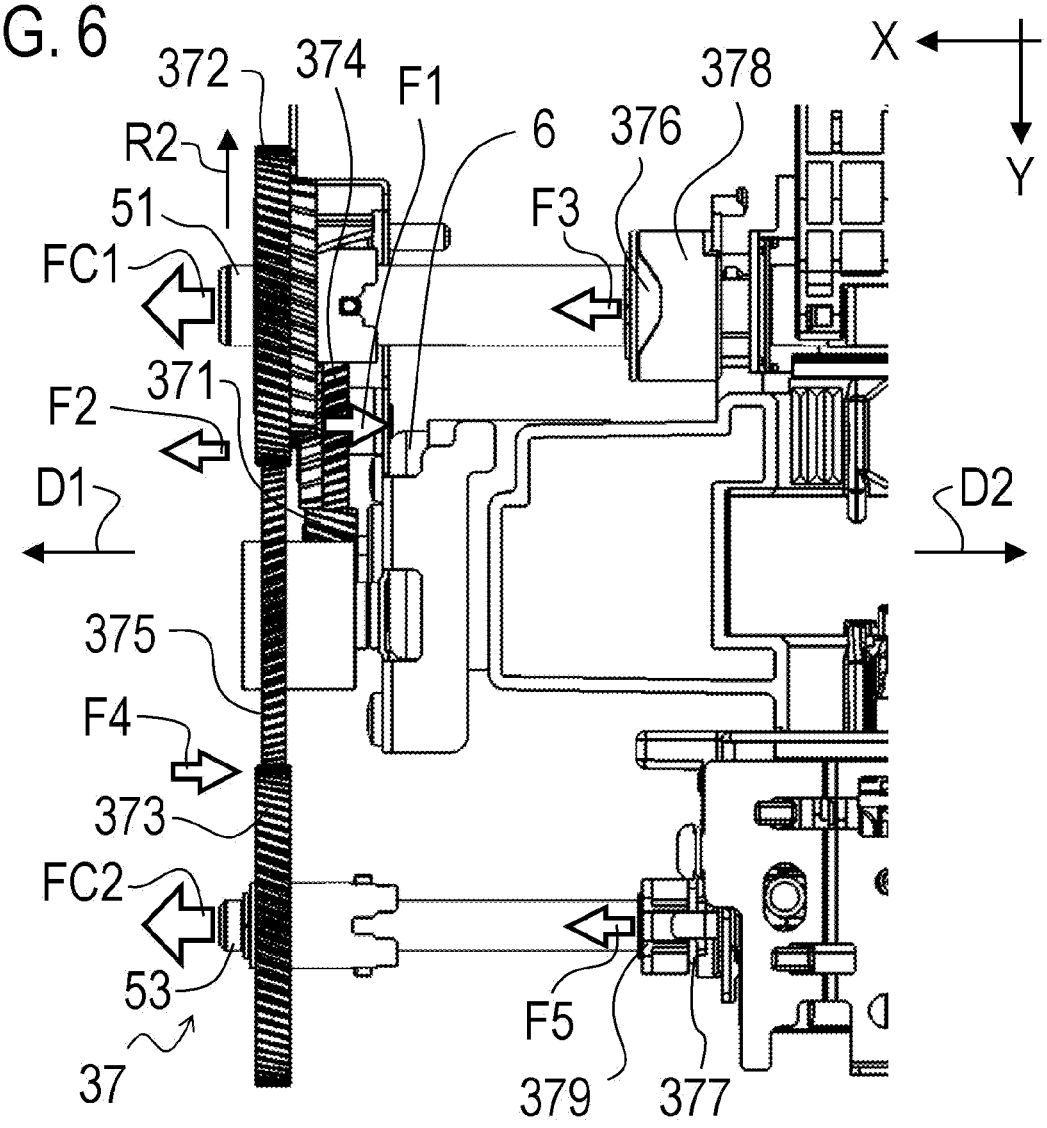
FIG. 6 is a top view depicting a state of the conveying roller in the backward rotation according to Embodiment 1.

Next, the forces which act on the conveying roller 51 when the conveying roller 51 rotates in the second rotating direction R2 (backward rotation) will be described. FIG. 6 is a top view depicting a state where the conveying roller 51 performs backward rotation, and the recording medium is conveyed to the upstream side in the conveying direction.

When the driving motor 6 drives the conveying roller 51 in the backward rotation direction, the force F1 acts in the second direction D2, and the force F2 acts in the first direction D1. Further, the conveying roller spring 376 energizes the conveying roller 51 in the first direction D1. Therefore, the resultant force FC1, which acts on the conveying roller 51 in the first direction D1, is given by FC1=−F1+F2+F3. In Embodiment 1, the force F3 is set so as to satisfy a relationship of F3>F1−F2 within the assumed conveying conditions. In other words, the resultant force FC1 of the conveying roller 51 in the rotary shaft direction acts in the first direction D1, and the conveying roller 51 is energized in the first direction D1.

As mentioned above, the resultant force FC1 of the force F3, which is the pressing force of the conveying roller spring 376, and the force F1 and the force F2, which are the thrust forces that the conveying roller gear 372 receives, acts in the first direction D1, regardless the rotating direction of the conveying roller 51. For example, in a case where the conveying roller 51 performs backward rotation and the force F1 is larger than the force F2, the thrust force acts in the second direction D2, but the force F3 satisfies the relationship of F3>F1−F2, hence the resultant force FC1 acts in the first direction D1. In other words, in Embodiment 1, it is set such that when the thrust force that the conveying roller gear 372 receives acts in the second direction D2, the pressing force of the conveying roller spring 376 becomes larger than this thrust force.

Because of this configuration, the resultant force FC1 acts in the first direction D1, whether the conveying roller 51 performs forward rotation or backward rotation. In other words, even at a timing when the rotating direction of the conveying roller 51 switches, the conveying roller 51 is constantly energized in the first direction D1. Further, the movement of the conveying roller 51 caused by the resultant force FC1 is regulated by the regulating member 378, regardless the rotating direction of the conveying roller 51. This means that, according to the configuration of Embodiment 1, the movement of the conveying roller 51 is constantly regulated when the conveying roller 51 is driven, whereby printing failures, such as a drop in printing quality and paper jam, can be prevented.

The movement of the conveying roller 51 in the rotary shaft direction is also prevented by the pinch roller 52 pressing the conveying roller 51 via the recording medium. Hence the pressing force of the pinch roller 52 also contributes to preventing printing failures, such as a drop in printing quality and paper jam.

Further, in the above configuration, the force F1, which the conveying roller gear 372 receives from the conveying idler gear 374, and the force F2 which the conveying roller gear 372 receives from the discharging idler gear 375, constantly turn to opposite directions. Hence there is no need to excessively increase the force F3 to turn the resultant force FC1 to the first direction D1. Furthermore, durability of members constituting the movement regulating mechanism of the conveying roller 51 can be improved. Thus in the configuration where the helical gears which integrally rotate with the conveying roller, engages with a plurality of gears, the tooth trace direction of each helical gear can be set such that the thrust force thereof acts in a direction cancelling each other out, whereby the pressing force of the pressing means can be decreased.

Forces which Act on Discharging Roller 53

Next forces which act on the discharging roller 53 in the rotary shaft direction when the gear train 37 is driven will be described. In Embodiment 1, the gear unit that engages with the discharging roller gear 373 and generates a thrust force on the discharging roller 53 includes the discharging idler gear 375. The discharging roller 53 is pressed by the discharging roller spring 377 in the first direction D1.

First, forces which act on the discharging roller 53 when the discharging roller 53 performs forward rotation will be described. In FIG. 5, a force F4 indicates the thrust force which the discharging roller gear 373 received from the discharging idler gear 375, and a force F5 indicates the pressing force which the discharging roller 53 receives from the discharging roller spring 377. In Embodiment 1, the absolute value of the force F4 is the same as the absolute value of the force F2.

The direction of the tooth trace of each gear is configured such that the force F4 acts in the first direction D1 when the driving motor 6 drives the discharging roller 53 in the forward rotation direction. At this time, the discharging roller spring 377 energizes the discharging roller 53 in the first direction D1. Therefore if it is assumed that the resultant force FC2, which acts on the discharging roller 53, acts in the first direction D1, the resultant force FC2 is given by FC2=F4+F5. In other words, the resultant force FC2 in the rotary shaft direction of the discharging roller 53 acts in the first direction D1, and the discharging roller 53 is energized in the first direction D1.

Next, the force which acts on the discharging roller 53 when the discharging roller 53 performs backward rotation will be described. As illustrated in FIG. 6, when the driving motor 6 drives the discharging roller 53 in the backward rotation direction, the force F4 acts in the second direction D2. Further, the discharging roller spring 377 energizes the discharging roller 53 in the first direction D1. Therefore the resultant force FC2, which acts on the discharging roller 53 in the first direction D1, is given by FC2=−F4+F5. In Embodiment 1, the force F5 is set so as to satisfy a relationship of F5>F4 within the assumed conveying conditions. In other words, the resultant force FC2 acts in the first direction D1, and the discharging roller 53 is energized in the first direction D1.

As mentioned above, the resultant force FC2 of the force F5, which is the pressing force of the discharging roller spring 377, and the force F4, which is the thrust force that the discharging roller gear 373 receives, act in the first direction D1, regardless the rotating direction of the discharging roller 53. In other words, in Embodiment 1, it is set such that when the thrust force that the discharging roller gear 373 receives acts in the second direction D2, the pressing force of the discharging roller spring 377 becomes larger than this thrust force.

Because of this configuration, the resultant force FC2 acts in the first direction D1, whether the discharging roller 53 performs forward rotation or backward rotation. In other words, even at a timing when the rotating direction of the discharging roller 53 switches, the discharging roller 53 is constantly energized in the first direction D1. Further, the movement of the discharging roller 53 caused by the resultant force FC2 is regulated by the regulating member 379, regardless the rotating direction of the discharging roller 53. This means that, according to the configuration of Embodiment 1, the movement of the discharging roller 53 is constantly regulated when the discharging roller 53 is driven, whereby printing failures, such as a drop in printing quality and paper jam, can be prevented.

The movement of the discharging roller 53 in the rotary shaft direction is also prevented by the spur 54 pressing the discharging roller 53 via the recording medium. Hence the pressing force of the spur 54 also contributes to prevent printing failures, such as a drop in printing quality and paper jam.

Further, in the above configuration, the resultant force FC1, which acts on the conveying roller 51, and the resultant force FC2, which acts on the discharging roller 53, act in the same direction. Hence, when the same recording medium is nipped by the conveying roller 51 and the pinch roller 52, and is also nipped by the discharging roller 53 and the spur 54, the conveying roller 51 and the discharging roller 53 do not move in the opposite directions, even if the conveying direction is switched. Furthermore, according to the configuration of Embodiment 1, the recording medium is not twisted, and the conveying accuracy of the recording medium improves.

In Embodiment 1, the discharging roller gear 373 is configured to engage only with the discharging idler gear 375, but when the present invention is applied, the discharging roller gear 373 may be configured to engage with a plurality of helical gears. In this configuration as well, a similar functional effect as the configuration of Embodiment 1 can be acquired if the pressing force of the discharging roller spring 377 is set such that the resultant force of the pressing force and the thrust force turn in the first direction D1.

Embodiment 2

Embodiment 2 of the present invention will be described next. A difference of Embodiment 2 from Embodiment 1 is that a helical output gear 380 is disposed at the edge of the conveying roller 51 on the second direction D2 side. In the following description on Embodiment 2, only the configuration that is the characteristic of Embodiment 2 will be described, omitting description on the configuration that is the same as Embodiment 1.

Figure 7B:
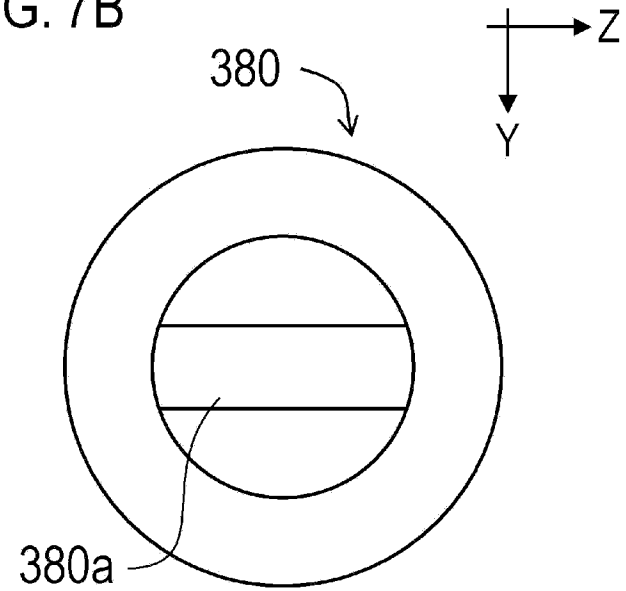
FIGS. 7A and 7B are top views depicting a helical output gear according to Embodiment 2.
Figure 7A:
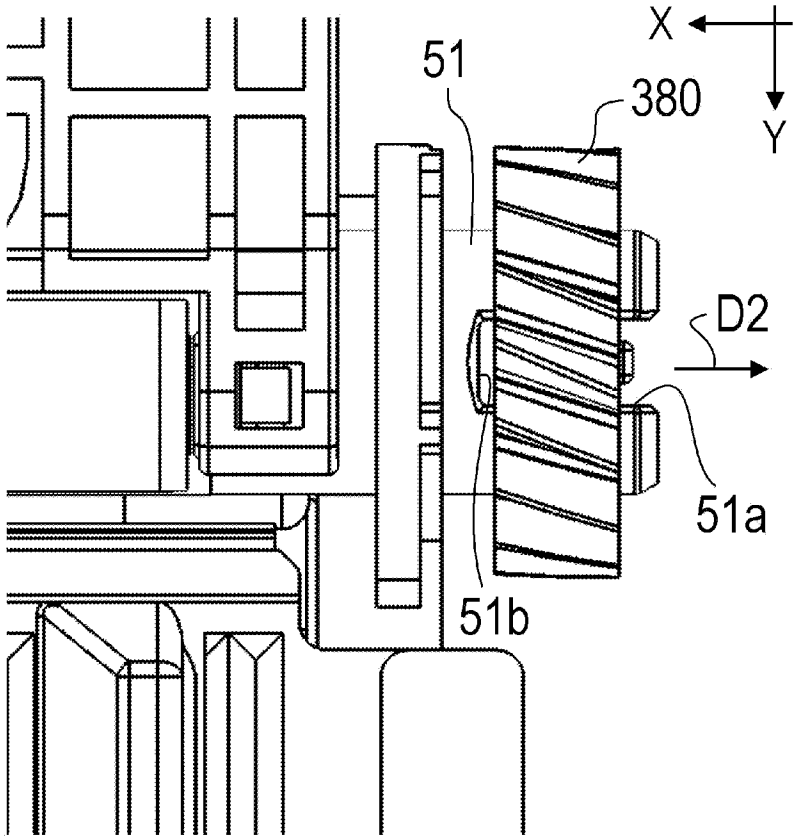

FIG. 7A is a top view depicting the edge of the conveying roller 51 on the second direction D2 side. FIG. 7B is a diagram depicting the helical output gear 380 which rotates along with rotation of the conveying roller 51. In the conveying roller 51 according to Embodiment 2, the conveying roller gear 372 is disposed at the edge on the first direction D1 side, and the helical output gear 380 is disposed at the edge on the second direction D2 side. A driven unit (not illustrated), which is driven by the rotation of the helical output gear 380, is connected to the helical output gear 380. In other words, in Embodiment 2, the helical output gear 380 is rotated by the rotation of the conveying roller 51, and the driven unit is driven thereby. Because of this configuration, the conveying roller 51, the discharging roller 53, and the driven unit are driven by the driving motor 6, without need of disposing a plurality of driving sources. According to the configuration of Embodiment 2, an increase in manufacturing cost can be suppressed, since there is no need to increase a number of driving sources.

The helical output gear 380 is configured to be movable from the conveying roller 51 in the thrust direction of the helical output gear 380 by the amount of clearance between these components. The tooth trace of the helical output gear 380 is configured such that when the conveying roller 51 performs forward rotation, the thrust force in the second direction D2 acts on the helical output gear 380, and when the conveying roller 51 performs backward rotation, the thrust force in the first direction D1 acts on the helical output gear 380.

As illustrated in FIG. 7B, an abutting surface 380*a*, which extends in the space of the inner peripheral surface, is formed in the helical output gear 380. A notched groove 51*a*, which extends in the rotary shaft direction, is formed at the edge of the conveying roller 51 on the second direction D2 side. When the helical output gear 380 moves in the first direction D1, the abutting surface 380*a* of the helical output gear 380 contacts with an end surface 51*b* of the notched groove 51*a* of the conveying roller 51, and movement of the helical output gear 380 in the first direction D1 is regulated.

On the other hand, when the helical output gear 380 moves in the second direction D2 by a predetermined amount in a state where the abutting surface 380*a* is in contact with the end surface 51*b*, the movement of the helical output gear in the second direction D2 is regulated by a regulating member (not illustrated). In other words, the thrust force in the first direction D1, that acts on the helical output gear 380, is transmitted to the conveying roller 51, but the thrust force in the second direction D2, that acts on the helical output gear 380, is not transmitted to the conveying roller 51.

Figure 8:
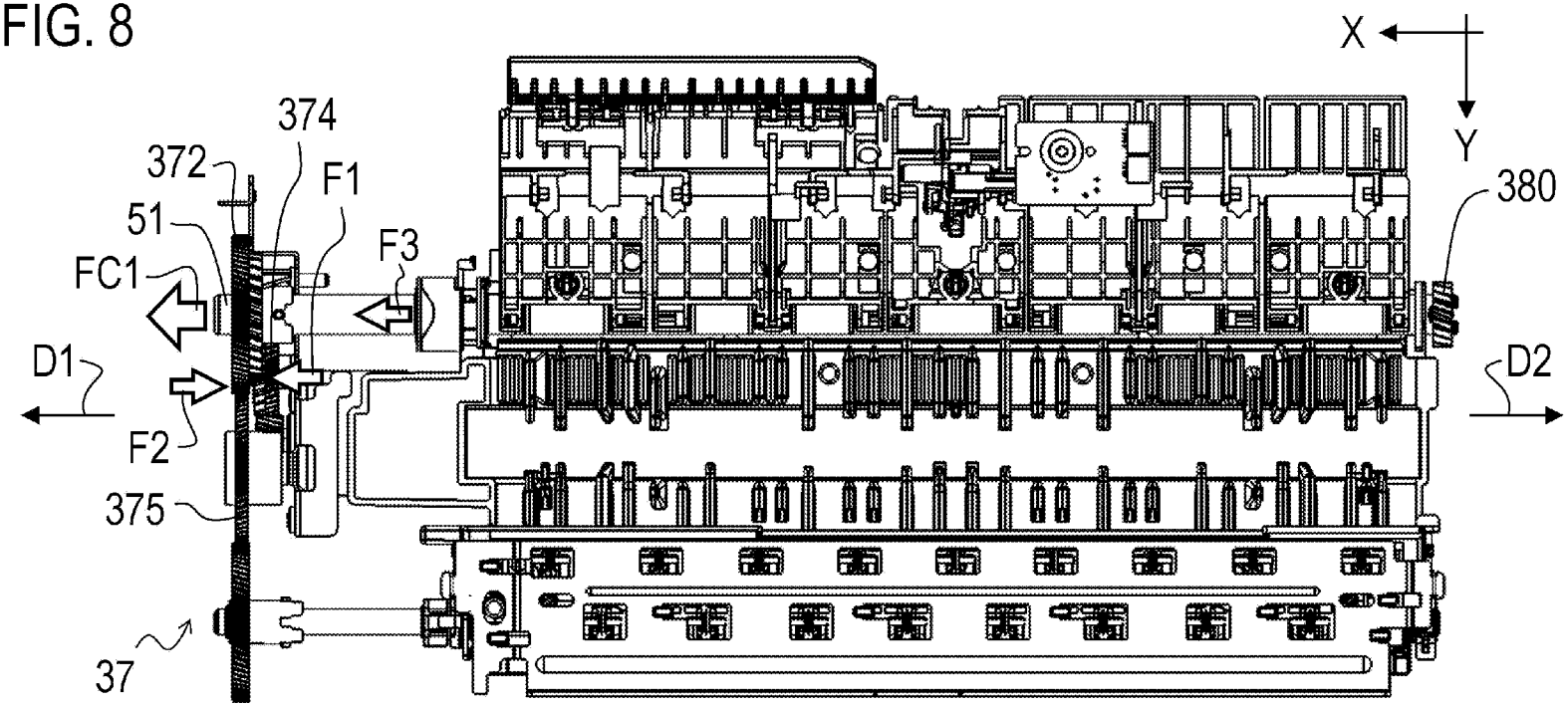
FIG. 8 is a top view depicting a state of the conveying roller in the forward rotation according to Embodiment 2.

Next, a force, which acts on the conveying roller 51 when the gear train 37 is driven, will be described. A force, which acts on the conveying roller 51 when the conveying roller 51 rotates, will be described first. FIG. 8 is a top view depicting a state where the conveying roller 51 performs forward rotation and the recording medium is conveyed to the downstream side in the conveying direction. In FIG. 8, a force F1 indicates a force which the conveying roller gear 372 receives from the conveying idler gear 374, a force F2 indicates a force which the conveying roller gear 372 receives from the discharging idler gear 375, and a force F3 indicates a force which the conveying roller 51 receives from the conveying roller spring 376. Further, in FIG. 8, a resultant force, which acts on the conveying roller 51 in the rotary shaft direction, is indicated as the resultant force FC1 in the rotary shaft direction of the conveying roller 51.

As mentioned above, when the driving motor 6 drives the conveying roller 51 in the forward rotation direction, the thrust force in the second direction D2 acts on the helical output gear 380, and the helical output gear 380 moves in the second direction D2, and the movement is regulated by the regulating member. Therefore the conveying roller 51 does not receive force from the helical output gear 380 in the rotary shaft direction of the conveying roller 51. In other words, if it is assumed that the resultant force FC1, which acts on the conveying roller 51, acts in the first direction D1, the resultant force FC1 is given by FC1=F1−F2+F3, just like Embodiment 1.

In Embodiment 2, the force F3 is set so as to satisfy the relationship of F3>−F1+F2 within the assumed conveying conditions. In other words, the resultant force FC1 acts in the first direction D1, and the conveying roller 51 is energized in the first direction D1.

Figure 9:
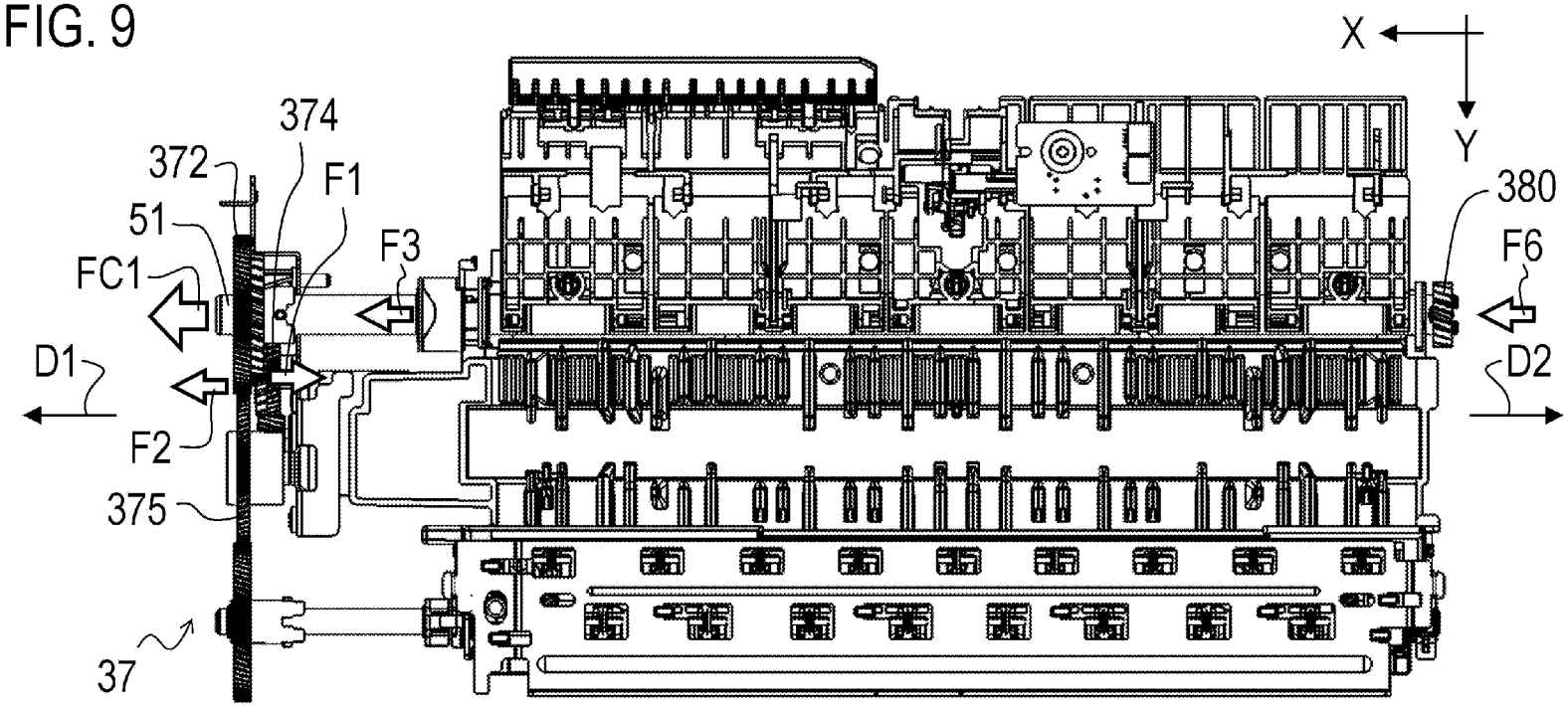
FIG. 9 is a top view depicting a state of the conveying roller in the backward rotation according to Embodiment 2.

Next, the force, which acts on the conveying roller 51 when the conveying roller 51 performs backward rotation, will be described. FIG. 9 is a top view depicting a state where the conveying roller 51 performs backward rotation and the recording medium is conveyed to the upstream side in the conveying direction.

As mentioned above, when the driving motor 6 drives the conveying roller 51 in the backward rotation direction, the thrust force in the first direction D1 acts on the helical output gear 380, and the helical output gear 380 moves in the first direction D1, and this movement is regulated by the conveying roller 51. Because of this configuration, the conveying roller 51 receives the force F6 in the first direction D1 from the helical output gear 380, in the rotary shaft direction of the conveying roller 51. In other words, in Embodiment 2, the conveying roller 51 receives the first thrust force from the conveying roller gear 372, receives the second thrust force from the helical output gear 380, and receives the pressing force from the conveying roller spring 376. If it is assumed that the resultant force FC1, which acts on the conveying roller 51, acts in the first direction D1, the resultant force FC1 is given by FC1=−F1+F2+F3+F6.

In Embodiment 2, the force F3 is set so as to satisfy the relationship of F3>F1−F2−F6 within the assumed conveying conditions. In other words, the resultant force FC1 acts in the first direction D1, and the conveying roller 51 is energized in the first direction D1. This means that in Embodiment 2, when the first thrust force, which the conveying roller gear 372 receives, acts in the second direction D2, the resultant force of the pressing force of the conveying roller spring 376 and the second thrust force which the helical output gear 380 receives is set to be larger than the first thrust force. According to Embodiment 2, the force F6 acts in the first direction D1, hence the force F3 generated by the conveying roller spring 376 can be set to be lower compared with Embodiment 1. Furthermore, durability of the members constituting the movement regulating mechanism of the conveying roller 51 can be improved.

According to the configuration of Embodiment 2, the movement of the conveying roller 51 in the rotary shaft direction can be prevented when the conveying roller 51 is rotating, and when the rotating direction is switched, hence printing failures can be prevented. Further, in the case where the force F1 acts strongly, the force F3 need not be set excessively high because of the action of the force F6, hence the configuration of Embodiment 2 is particularly effective. In the above configuration, the helical output gear 380 is disposed at the edge of the conveying roller 51 on the second direction D2 side, but when the present invention is applied, the helical output gear 380 may be disposed in a different location of the conveying roller 51.

Modifications

The application of the present invention is not limited to the above mentioned configurations, but the present invention is applicable to other configurations within a scope where the identity of the present invention is not diminished. For example, in the above embodiments, the movement of the conveying roller 51 in the first direction D1 is regulated while energizing the conveying roller 51 in the first direction D1, but the energizing direction and the direction in which the movement is restricted may be the second direction D2. In Embodiment 2, the helical output gear 380 is disposed at the edge of the conveying roller 51, but a similar output gear may be disposed at the edge of the discharging roller 53 as well.

In the above embodiments, the conveying roller gear 372, which rotates integrally with the conveying roller 51, engages with two helical gears, but the application of the present invention is not limited to this configuration. For example, the present invention is also applicable to a configuration where the conveying roller gear 372 engages with a single helical gear, or a configuration where the conveying roller gear 372 engages with three or more helical gears. In other words, the gear unit that engages with the conveying roller gear 372 may include at least one helical gear. Any of these configurations are acceptable, as long as the pressing force and the tooth trace direction of the helical gear are set such that the resultant force of the conveying roller 51 in the rotary shaft direction, including the pressing force of the pressing means and the thrust force which the conveying roller 51 receives, turns to the first direction D1, regardless the rotating direction of the conveying roller gear 372.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2022-152977, filed on Sep. 26, 2022, which is hereby incorporated by reference herein in its entirety.

What is claimed is:

1. A conveying apparatus comprising:

a conveying roller that conveys a recording medium;

a first helical gear that rotates integrally with the conveying roller;

a gear unit including a second helical gear and a third helical gear, the gear unit engaging with the first helical gear and generating a thrust force on the conveying roller;

a regulating mechanism regulating movement of the conveying roller in a rotary shaft direction; and a spring positioned to press the conveying roller to the regulating mechanism in a pressing direction with a pressing force, wherein the thrust force that the conveying roller receives from the second helical gear acts in an opposite direction of the thrust force that the conveying roller receives from the third helical gear, and wherein movement of the conveying roller caused by a resultant force in the rotary shaft direction is regulated by the regulating mechanism regardless of a rotating direction of the conveying roller, the resultant force including the pressing force and the thrust force.

2. The conveying apparatus according to claim 1, wherein the pressing force is greater than the thrust force generated in a case where the thrust force that the conveying roller receives from the gear unit acts in an opposite direction of the pressing direction.

3. The conveying apparatus according to claim 1, further comprising a driving source that drives the conveying roller, wherein the second helical gear transmits a driving force of the driving source to the first helical gear.

4. The conveying apparatus according to claim 3, wherein the first helical gear is a two-step gear that includes a first gear portion which engages with the second helical gear, and a second gear portion which engages with the third helical gear, and wherein tooth trace directions of the first gear portion and the second gear portion are the same direction.

5. The conveying apparatus according to claim 3, wherein the conveying roller is a first conveying roller and the thrust force is a first thrust force, and the conveying apparatus further comprises:

a second conveying roller that conveys the recording medium by rotating in the same direction as the first conveying roller; and a fourth helical gear that rotates integrally with the second conveying roller, the fourth helical gear engaging with the third helical gear, and the third helical gear generating a second thrust force on the second conveying roller.

6. The conveying apparatus according to claim 5, wherein the resultant force is a first resultant force, the regulating mechanism is first regulating mechanism, the rotary shaft direction is a first rotary shaft direction, the spring is first spring, the pressing direction is a first pressing direction, the pressing force of the first spring is a first pressing force, and the conveying apparatus further comprises:

a second regulating mechanism that regulates movement of the second conveying roller in a second rotary shaft direction; and a second spring positioned to press the second conveying roller to the second regulating mechanism in a second pressing direction with a second pressing force, wherein movement of the second conveying roller caused by a second resultant force in the rotary shaft direction of the second conveying roller is regulated by the second regulating mechanism regardless of a rotating direction of the second conveying roller, the resultant force including the second pressing force and the second thrust force.

7. The conveying apparatus according to claim 1, further comprising:

a helical output gear that rotates along with rotation of the conveying roller; and a driven unit that is driven by the helical output gear, wherein the helical output gear presses the conveying roller in the pressing direction in a case where the conveying roller rotates in a first rotating direction, and does not press the conveying roller in a case where the conveying roller rotates in a second rotating direction, which is an opposite direction of the first rotating direction.

8. The conveying apparatus according to claim 7, wherein the helical output gear is configured to be movable in the rotary shaft direction of the conveying roller, and includes an abutting surface which contacts the conveying roller in a case where the helical output gear moves in the pressing direction.

9. The conveying apparatus according to claim 7, wherein in a case where the thrust force that the conveying roller receives from the gear unit is a first thrust force, the resultant force that acts on the conveying roller further includes a second thrust force for the helical output gear to press the conveying roller in the pressing direction, and wherein a resultant force of the pressing force and the second thrust force is larger than the first thrust force generated in a case where the first thrust force acts in an opposite direction of the pressing direction.

10. The conveying apparatus according to claim 1, wherein the spring is an energizing member that is disposed such that an elastic force acts in the rotary shaft direction of the conveying roller.

11. The conveying apparatus according to claim 1, wherein the regulating mechanism includes a bushing into which the conveying roller is inserted.

12. A recording device, comprising:

a recording portion that performs recording operation on a recording medium; and a conveying apparatus that conveys the recording medium, the conveying apparatus including:

a conveying roller that conveys the recording medium;

a first helical gear that rotates integrally with the conveying roller;

a gear unit including a second helical gear and a third helical gear, the gear unit engaging with the first helical gear and generating a thrust force on the conveying roller;

a regulating mechanism regulating movement of the conveying roller in a rotary shaft direction; and a spring positioned to press the conveying roller to the regulating mechanism in a pressing direction with a pressing force, wherein the thrust force that the conveying roller receives from the second helical gear acts in an opposite direction of the thrust force that the conveying roller receives from the third helical gear, and wherein movement of the conveying roller caused by a resultant force in the rotary shaft direction is regulated by the regulating mechanism regardless of a rotating direction of the conveying roller, the resultant force including the pressing force and the thrust force.

* * * * *